US006817440B1

(12) United States Patent
Kim

(10) Patent No.: US 6,817,440 B1
(45) Date of Patent: Nov. 16, 2004

(54) MULTI-CHANNEL HEADPHONES

(75) Inventor: Sung-Il Kim, Seongnam (KR)

(73) Assignee: MM Gear Co., Ltd., Seoul (KR)

( * ) Notice: Subject to any disclaimer, the term of this patent is extended or adjusted under 35 U.S.C. 154(b) by 79 days.

(21) Appl. No.: 10/204,709

(22) PCT Filed: Aug. 17, 2000

(86) PCT No.: PCT/KR00/00918

§ 371 (c)(1),
(2), (4) Date: Oct. 23, 2002

(87) PCT Pub. No.: WO01/63967

PCT Pub. Date: Aug. 30, 2001

(30) Foreign Application Priority Data

Feb. 26, 2000 (KR) ..... 2000-9587

(51) Int. Cl.[7] ..... H04R 25/00

(52) U.S. Cl. ..... 181/128; 181/129; 181/130; 381/309; 381/310; 381/300; 381/307; 381/371

(58) Field of Search ..... 381/309, 310, 381/300, 307, 371; 181/128, 129, 130

(56) References Cited

U.S. PATENT DOCUMENTS

| | | | | |
|---|---|---|---|---|
| 3,794,779 A | * | 2/1974 | Greuzerd et al. | 381/5 |
| 3,796,840 A | * | 3/1974 | Ohta | 381/5 |
| 4,821,323 A | | 4/1989 | Papiernik | 381/309 |
| 5,684,879 A | * | 11/1997 | Verdick | 381/300 |

FOREIGN PATENT DOCUMENTS

| | | |
|---|---|---|
| JP | 58-189691 | 12/1983 |
| JP | 63-169790 | 11/1988 |
| JP | 63-318900 | 12/1988 |
| JP | 01-314098 | 12/1989 |
| JP | 06-113384 | 4/1994 |

* cited by examiner

*Primary Examiner*—Shih-Yung Hsieh
(74) *Attorney, Agent, or Firm*—Lowe Hauptman Gilman & Berner LLP

(57) ABSTRACT

Multi-channel headphones capable of providing quality 3-dimensional (3-D) sound in an atmosphere of intimacy and privacy for individuals is provided. The multi-channel headphones ensure high-quality 3-D sound reproduction with accurate phase using distinct speaker units for multiple channels. The multi-channel headphones includes at least two speaker units for each ear piece, each for generating distinct sounds from multiple channels; and at least two enclosures in each of which each of the at least two speaker units arc installed. The multi-channel headphones include a sound guide portion in each of the enclosures to guide the sound emanating from the corresponding speaker unit into the listener's ear. A diffraction effect of the sound from the rear speaker can be induced. The multi-channel headphones can reproduce 3-D sound with the distinctness, spatial character caused by wide sound field, and directional phantom image, by arranging two speaker units for each ear piece in the front and rear directions around the listener's ear. Themultichannel headphones can efficiently reproduce sound from a 5.1 channel system, using only four speaker units.

10 Claims, 4 Drawing Sheets

MULTI-CHANNEL HEADPHONES

TECHNICAL FIELD

The present invention relates to multi-channel headphones for use in reproducing sound in an atmosphere of intimacy and privacy for individuals, and more particularly, to multi-channel headphones capable of reproducing 3 dimensional (3-D) sound with at least two speaker units for each ear piece.

BACKGROUND ART

With the development of personal computer (PC) based multimedia and digital communications technologies, the demand for headphones, earphones or headsets, which are suitable for entertainments such as seeing movies and listening music, and capable of providing improved virtual reality, gaming simulation, chatting or Internet telephony services, is sharply increasing.

To implement more enjoyable 3-D image based virtual reality simulations, reproduction of 3-D sound or at least almost 3-D sound is an inevitable necessity. Among a number of functions provided by PCs, multimedia and digital telecommunications functions whose importance is increasing are based on image and sound related technology. With the advance in image related technology, for example, associated with graphic cards or displays, high quality images become available for the customer. Also, many approaches have been used to provide more impressive 3-D sound. As a result of the efforts, there are "surround" sound systems capable of providing spatial effects with 4 speakers, two more than a conventional stereo system, arranged to create sound fields in the front and rear directions, and the 5.1-channel system with 6 speaker units: four main speakers arranged in front left, front right, rear left and rear right around the listener, one central signal speaker for creating a phantom center image, and an woofer for providing non-directional low-frequency content to reinforce the sounds from the main speakers with bass.

The performance of sound cards has been greatly improved. However, sound related technique applications are quietly behind the applications of image related technologies. One main reason for this lies in the small size of headphones. For 3-D sound reproduction, a wide space is required to arrange at least four speakers spaced apart from each other. However, speaker enclosures for headphones are too small to receive two or more speaker units therein.

Korean Patent Laid-open Publication No. 78-399 and Korean Utility Model Laid-open Publication No. 1998-058453 disclose a variety of arrangements of speaker units within each ear piece of headphones. Korean Patent No. 124394 also discloses alternative arrangements of a plurality of speaker units using movable supports on a baffle to provide high-quality sound, like using more than 5 channels, with variable timbre. For these conventional configurations of multi-channel headphones, a closed type speaker housing pair that completely surrounds the listeners ears, like conventional stereo headphones, is adopted, each of which receives two or more speaker units for emanating sound from different channels.

The location of a sound source can be perceived a difference in phase of acoustic waves as well as a difference in acoustic intensity sensed by the listener's ear. Although existing stereo headphones are successful in producing a binaural effect with two separate R- and L-channel speakers, which enables the listener to perceive the location of a sound source, stereo headphones are not suitable for reproducing 3-D sound, which needs more than two speaker units for each ear piece.

If two or more speaker units are mounted in one small housing of conventional headphones, sound waves emanating from the discrete speaker units reflect from the interior wall of the housing, causing interference, thereby smearing phases and deteriorating a spatial effect. The most disruptive effect is the generation of noise due to resonance within the small housing. Accordingly, the spatial and binaural effects are degraded, localizing the sound image over the listeners head. In this case, the listener cannot experience 3D sound and may not even be able to discriminate which speaker units sounds originate from.

DISCLOSURE OF THE INVENTION

To solve the problems, it is an object of the present invention to provide open-style multi-channel headphones, in which at least two enclosures are provided for each ear piece, and at least two speaker units are mounted in each of the enclosures, so that sound from each discrete channel can be reproduced intact with accurate phase.

It is another object of the present invention to provide multi-channel headphones designed in consideration of the reverberation and a phantom image that are necessary for spatial 3-D sound effect.

It is still another object of the present invention to provide multi-channel headphones capable of effectively producing 3-D sound, which can be reproduced with 5 or more channels, with just four speaker units: two for the left side and two for the right side, in which the sound transmission system is optimized for each of the speaker units.

To achieve the objects of the present invention, there is provided multi-channel headphones comprising: at least two speaker units for each ear piece, each for generating distinct sounds from multiple channels; and at least two enclosures in each of which each of the at least two speaker units are installed. The multi-channel headphones can prevent interference of sound waves from different channels.

It is preferable that the at least two enclosures are arranged spaced apart from each other in the front and rear around the listener's ear, and the multi-channel headphones further comprises a sound guide portion for each of the at least two enclosures, the sound guide portion for guiding the sound emanating from the corresponding speaker unit into the listener's ear. The multi-channel headphones can provide a sufficient reverberation effect during traveling of sound waves along the sound guide portion. In this case, it is more preferable that each of the at least two enclosures further comprises a sound reflection plate extending from the end of the corresponding sound guide portion, the sound reflection plate being tilted such that the sound reflected by the sound reflection plate goes toward the listener's auricle.

It is preferable that the multi-channel headphones further comprise a plurality of guide ribs on the interior surface of each of the sound guide portions to create a plurality of sound passages. It is preferable that a number of projections are regularly or irregularly formed on the interior surfaces of the sound guide portions and sound reflection plates, to scatter the sounds.

The sound reflection plate of the front enclosure is positioned around the upper portion of the listeners ear, and the sound reflection plate of the rear enclosure is positioned around the lower portion of the listener's ear, such that the sound waves reflected by the sound reflection plates go toward the listener's auricle. The sound reflection plate of the rear enclosure induces diffraction of sound from the rear speaker unit. The resonant portion of the rear enclosure is expanded for sound amplification.

BEST MODE FOR CARRYING OUT THE INVENTION

The present invention will now be described more fully with reference to the accompanying drawings, in which preferred embodiments of the invention are shown. This invention may, however, be embodied in many different forms and should not be construed as being limited to the is embodiments set forth herein.

Figure 1:
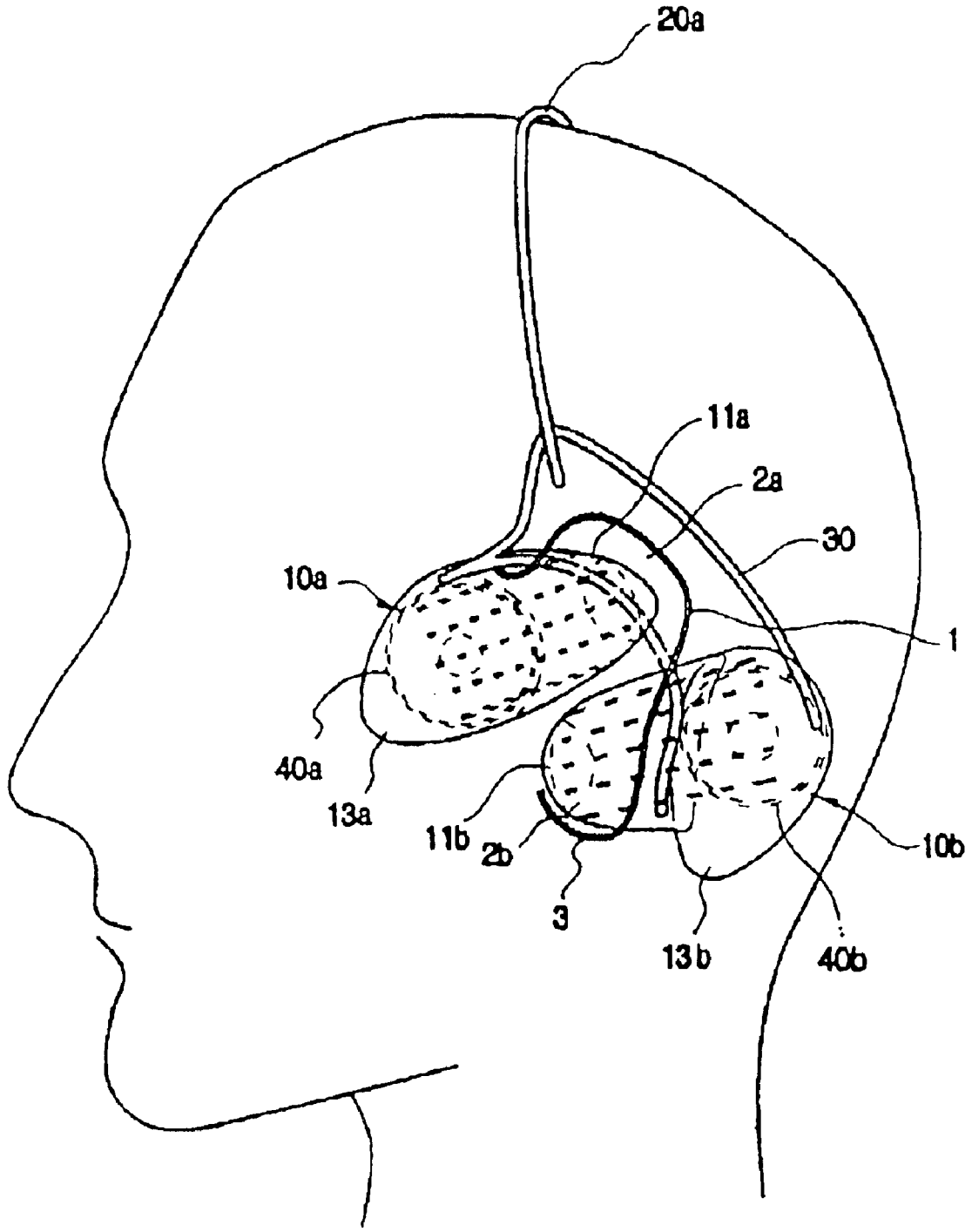
FIG. 1 illustrates a left ear piece of a pair of multi-channel headphones worn over a listener's head, according to a preferred embodiment of the present invention.
Figure 2:
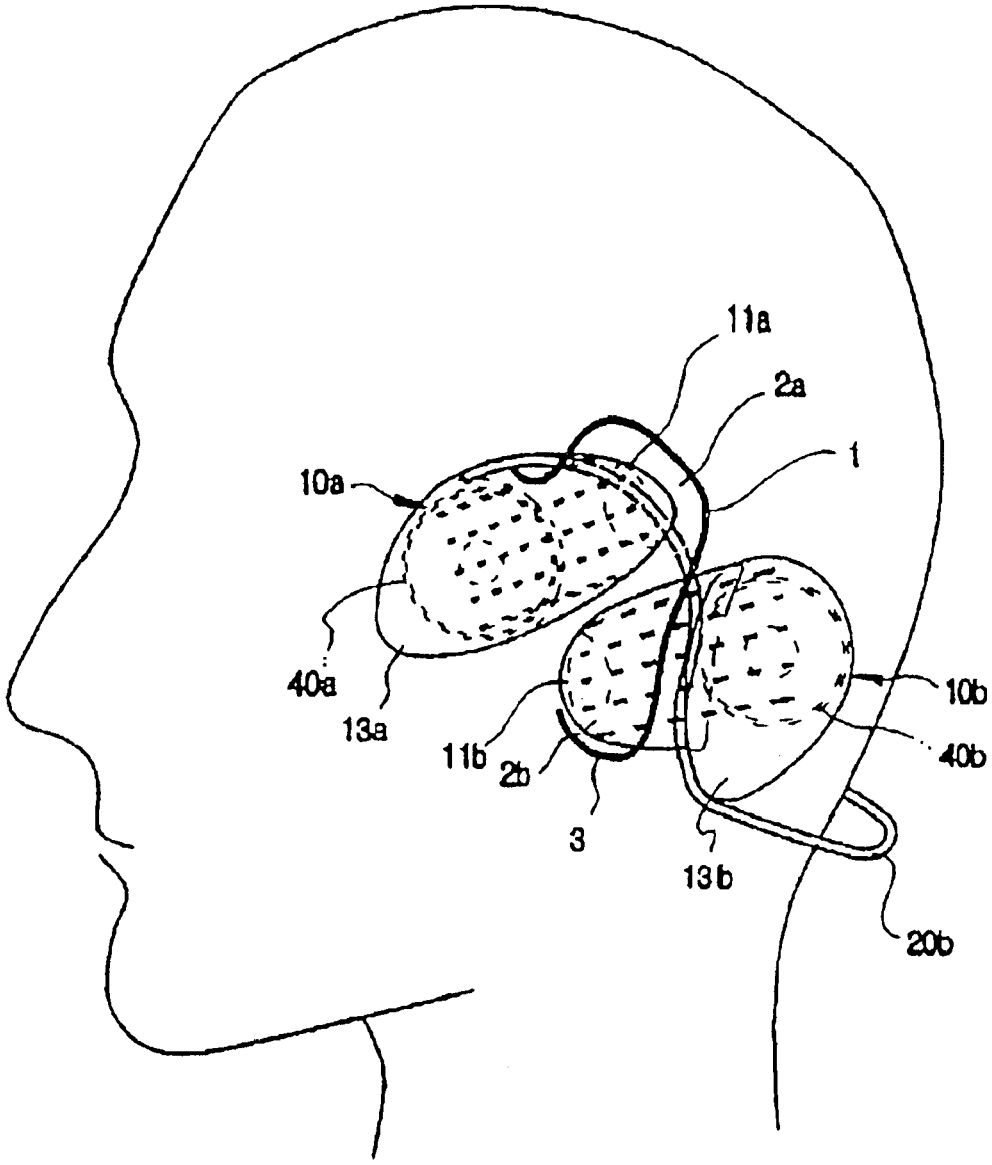
FIG. 2 illustrates another style of wearing the multi-channel head phones of FIG. 1 around the back of the listener's head, according to the present invention.

Examples of the multi-channel headphones according to the present invention, which are engaged over the listener's head, are shown in FIGS. 1 and 2. In FIGS. 1 and 2, only the left ear piece of the multi-channel headphones is illustrated. The right ear piece is engaged symmetrically to the left ear piece on the right side, and thus a description of the right ear piece will not provided here.

Referring to FIG. 1, the multi-channel headphones according to the present invention include two enclosures 10*a* and 10*b* for the left ear piece which are arranged spaced apart from each on the front and rear of the listener's left ear 1, respectively. The front and rear enclosures 10*a* and 10*b* are engaged over the listener's head by a common headband 20*a*. Reference numeral 30 denotes a connection support member appropriately curved to rest stably on the listener's head while connecting the two enclosures 10*a* and 10*b* to the end of the headband 20*a*. Another style of wearing the multi-channel headphones is illustrated in FIG. 2. As shown in FIG. 2, each of the front and rear enclosures 10*a* and 10*b* can be directly connected to a headband 20*b* which is shaped to fit snugly around the lower back of the listeners head, and the ends of the headband 20*b* are engaged stably behind the listener's ears. Although modifications of the connection member for supporting and connecting two or more enclosures are not fully illustrated here, the connection member can be varied in many different forms.

The two front and rear enclosures 10*a* and 10*b*, which are shaped substantially like a shell, are arranged spaced apart from each other on the front and rear of the listeners ear 1. Speaker units 40*a* and 40*b* are mounted in the front and rear enclosures 10*a* and 10*b*, respectively, far away from the listeners ear. The front and rear enclosures 10*a* and 10*b* includes sound guide portions 11*a* and 11*b* for guiding sounds emanating from the speaker units 40*a* and 40*b* toward the upper and lower portions 2*a* and 2*b* of the listeners auricle, respectively.

Figure 3A:
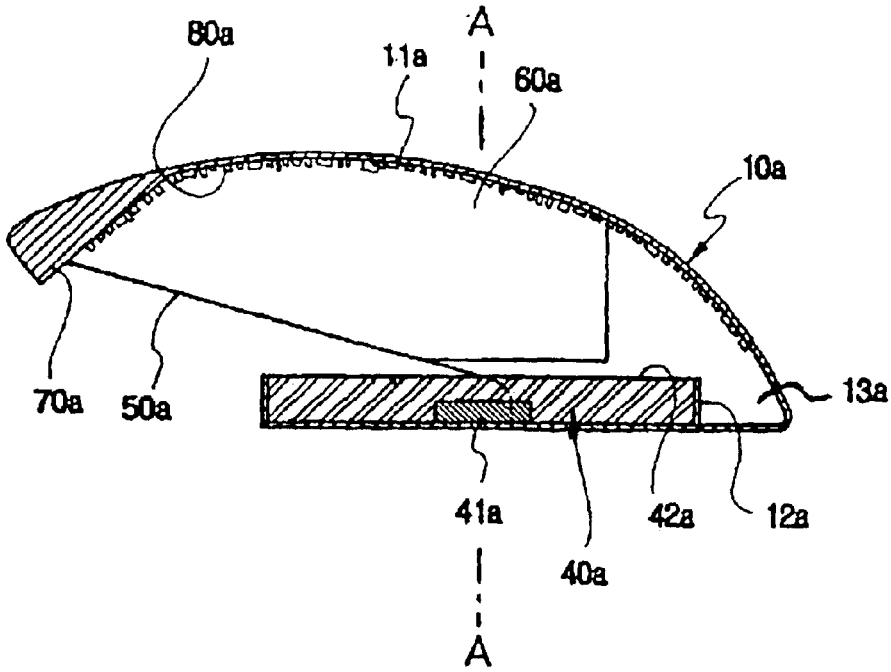
FIG. 3A is a sectional view illustrating the internal structure of a front enclosure of the multi-channel headphones according to the present invention.
Figure 3B:
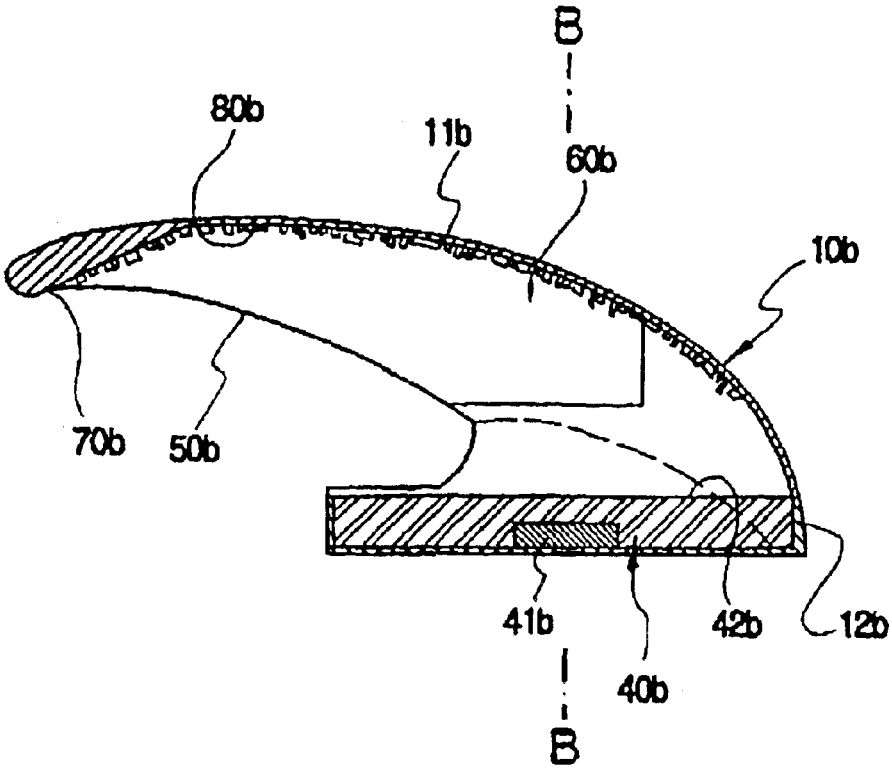
FIG. 3B is a sectional view illustrating the internal structure of a rear enclosure of the multi-channel headphones according to the present invention.

The internal structures of the front and rear enclosures 10*a* and 10*b* are illustrated in FIGS. 3A and 3B. The front and rear enclosures 10*a* and 10*b* include speaker reception units 12*a* and 12*b* on their bases, respectively, which are fitted to receive the speaker units 40*a* and 40*b*, respectively. The speaker reception units 12*a* and 12*b* are open toward the interior walls of the sound guide portions 11*a* and 11*b*. Diaphragms 42*a* and 42*b* are mounted so as to cover the speaker reception units 12*a* and 12*b*. The bases of the front and rear enclosures 10*a* and 10*b* are closed and contact the listener's face. Voice coils 41*a* and 41*b*, which are common, are mounted in the speaker units 40*a* and 40*b*. The voice coils 41*a* and 41*b* vibrate the diaphragms 42 and 42*b* covering the speaker reception units 12*a* and 12*b*, thereby reproducing sounds.

On the interior surface of the sound guide portions 11*a* and 11*b* a number of parallel guide ribs 50*a* and 50*b* extend spaced apart from each other in the longitudinal direction to form a number of sound passages 60*a* and 60*b*. Sound reflection plates 70*a* and 70*b* extend from the ends of the sound guide portions 11*a* and 11*b*, i.e., the sound output ends of the sound passages 60*a* and 60*b*. Also, a large number of small projections 80*a* and 80*b* are formed on the interior surfaces of the sound guide portions 11*a* and 11*b*, and the sound reflection plates 70*a* and 70*b*.

In particular, the sound reflection plates 70*a* and 70*b* are curved at a predetermined angle with respect to the sound guide portions 11*a* and 11*b*, such that sounds transmitted along the sound passages 60*a* and 60*b* are reflected and diffracted toward the upper and lower portions 2*a* and 2*b* of the listener's ear. The projections 80*a* and 80*b* scatter sounds during the transmission within the enclosures 10*a* and 10*b*. The heights and gaps of the projections 80*a* and 80*b* may be varied regularly or irregularly according to the sound scattering conditions. The projection 80*a* and 80*b* may be formed of an is elastic material such that they can scatter and damp the sounds without causing unnecessary reverberation or fluctuation.

Figure 4A:
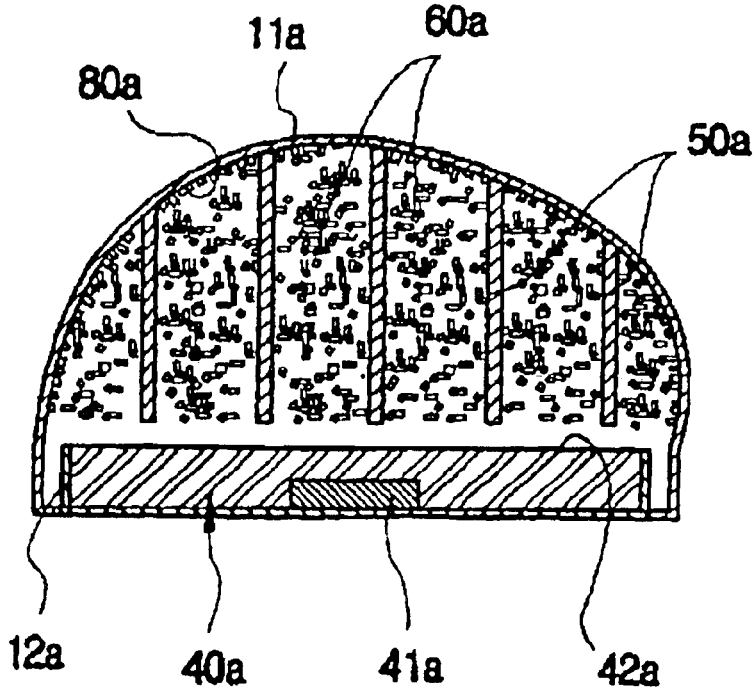
FIG. 4A is a sectional view of the front enclosure taken along line A—A of FIG. 3A.
Figure 4B:
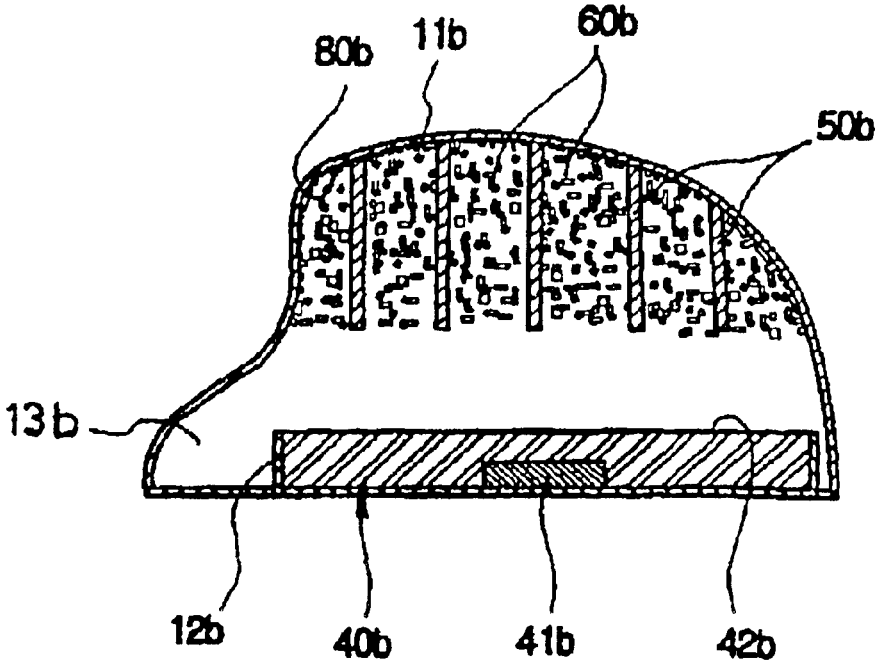
FIG. 4B is a sectional view of the rear enclosure taken along line B—B of FIG. 3B.

As can be seen from FIGS. 3A and 4B, the front and rear enclosures 10*a* and 10*b* further have resonant portions 13*a* and 13*b* near the speaker reception units 12*a* and 12*b*. The resonant portion 13*b* of the rear enclosure 12*b* is placed slightly away from the listener's earlobe, as shown in FIG. 2.

In operation, as a sound signal processed by a general 3-D sound processor (not shown) is applied to the voice coils 41*a* and 41*b* mounted in the speaker units 40*a* and 40*b* through multiple channels, the voice coils 41*a* and 41*b* and then the diaphragms 42*a* and 42*b* vibrate, thereby producing distinct sounds from each of the multiple channels, which are different in wavelength, phase and tone from one another.

In the multi-channel headphones according to the present invention, each of the speaker units 40*a* and 40*b* is separately mounted in the front and rear enclosures 10*a* and 10*b*, so that distinct sounds from multiple channels can be reproduced without interference of the sounds from different channel. In addition, since the sound reflection plates 70*a* and 70*b*, which extend from the sound guide portions 11*a* and 11*b*, are placed close to the upper and lower portions 2*a* and 2*b* of the listener's auricle, sound waves can reach the eardrum with almost no interference.

The sounds emanating from the speaker units 40*a* and 40*b* radiate as direct sounds toward the interior surface of the sound guide portions 11*a* and 11*b*. The direct sounds travel along the sound passages 60*a* and 60*b*, and are then repeatedly reflected and diffracted by the sound reflection plates

70*a* and 70*b* extending from the sound guide portions 60*a* and 60*b*, thereby reaching the eardrum. During the traveling of the sounds within the enclosures 10*a* and 10*b*, the direct sounds from the speaker units 40*a* and 40*b*, and the sounds reflected by the interior walls of the sound guide portions 11*a* and 11*b*, and by the walls of the guide ribs 50*a* and 50*b*, can be perceived by the listener. In other words, both the direct and reflected sounds reach the listener's eardrum, which allows the listener to perceive spatial character as if he or she is sitting in a concert hall.

The projections 80*a* and 80*b* attached to the interior wall of the sound guide portions 70*a* and 70*b* widely disperse the sounds by scattering, thereby boosting the spatial effect with extended sound field. As a result, effective 3D sound reproduction can be achieved by the multi-channel headphones according to the present invention.

The resonant portions 13*a* and 13*b* located at the ends of the front and rear enclosures 40*a* and 40*b* far away from the listener's auricle amplify the direct sounds from the speaker units 40*a* and 40*b*. The resonant portion 13*b* of the rear enclosure 10*b* is placed in the rear direction slightly away from the earlobe 2. Although the previous embodiments are described with reference to the left ear piece, it will be appreciated that the right ear piece is placed in the same fashion. Due to the binaural effect, and the diffraction effect of the sound from the rear speaker unit, the listener can experience almost 3-D sounds that provide a directional phantom image, with the multi-channel headphones according to the present invention.

INDUSTRIAL APPLICABILITY

As previously described, in the multi-channel headphones according to the present invention, discrete speaker units for multiple channels are mounted in separate enclosures, which allows the listener to perceive transparent sound with accurate phase emanating from different channels. Due to the reflection and scattering of sounds during transmission within the enclosures, high-quality sounds can be produced with the essential phonic elements for 3-D sounds, i.e, all with the distinctness, spatial character caused by wide sound field, and directional phantom image.

The multi-channel headphones according to the present invention can provide all the stereophonic elements with just four speaker units: by arranging two speaker units for each ear piece in the front and rear directions around the listener's ear with a predetermined distance therebetween. Accordingly, the multi-channel headphones can effectively reproduce sound from a 5.1-channel systems. The multi-channel headphones according to the present invention can produce impressive 3-D sounds with efficiency.

The multi-channel headphones according to the present invention will become more useful with the advance in computer-based multimedia and digital communications technologies. For example, the multi-channel headphones are effective in enjoying 3-D image based virtual reality gaming simulations, or is efficient for military or flying training under simulated combat conditions.

What is claimed is:

1. Multi-channel headphones, comprising for each ear piece:

at least two speaker units, each for generating distinct sounds from multiple channels; and at least two enclosures in each of which one of the at least two speaker units is installed, wherein the at least two enclosures are arranged spaced apart from each other in the front and rear around the listener's ear; and a sound guide portion for each of the at least two enclosures, the sound guide portion for guiding the sound emanating from the corresponding speaker unit into the listener's ear.

2. The multi-channel headphones of claim 1, wherein at least one of the enclosures comprises a resonant portion for amplifying the sound emanating from the corresponding speaker unit to create a phantom image.

3. The multi-channel headphones of claim 1, wherein one of the at least two enclosures which is arranged in the rear of the listener's ear is adapted to be slightly far away from the listener's ear lobe, to ensure sooth diffraction of the sound emanating from the corresponding speaker unit.

4. The multi-channel headphones of claim 1, further comprising a plurality of guide ribs on the interior surface of each of the sound guide portions, the plurality of guide ribs for creating a plurality of sound passages.

5. The multi-channel headphones of claim 1, wherein each of the at least two enclosures further comprises a sound reflection plate extending from the end of the corresponding sound guide portion, the sound reflection plate being tilted such that the sound reflected by the sound reflection plate goes toward the listeners auricle.

6. The multi-channel headphones of claim 5, further comprising a number of projections on the interior surfaces of the sound guide portions and sound reflection plates, to scatter the sounds.

7. The multi-channel headphones of claim 5, wherein the sound reflection plates extending from the ends of the sound guide portions are arranged such that the sounds reflected by the sound reflection plates go toward the lower and upper portions of the listener's auricle.

8. The multi-channel headphones of claim 1, wherein each of the at least two enclosures further comprises a sound reflection plate extending from the end of the corresponding sound guide portion, the sound reflection plate being tilted such that the sound reflected by the sound reflection plate goes toward the listener's auricle.

9. The multi-channel headphones of claim 8, further comprising a number of projections on the interior surfaces of the sound guide portions and sound reflection plates, to scatter the sounds.

10. The multi-channel headphones of claim 8, wherein the sound reflection plates extending from the ends of the sound guide portions are arranged such that the sounds reflected by the sound reflection plates go toward the lower and upper portions of the listener's auricle.

* * * * *